United States Patent [19]

Chang

[11] 4,436,004

[45] Mar. 13, 1984

[54] UNIVERSAL MULTI-SOCKET RATCHET WRENCH

[76] Inventor: Hui-Huang Chang, 21, Alley 17, Lane 65 Chung-Chin Rd., Taichung City, Taiwan

[21] Appl. No.: 354,482

[22] Filed: Mar. 3, 1982

[30] Foreign Application Priority Data

Oct. 5, 1981 [TW] Taiwan ..... 7025849

[51] Int. Cl.[3] ..... B25B 13/46

[52] U.S. Cl. ..... 81/60; 81/128

[58] Field of Search ..... 81/60, 128, 129, 165

[56] References Cited

U.S. PATENT DOCUMENTS

| | | | |
|---|---|---|---|
| 679,929 | 8/1901 | Webster | 81/128 |
| 915,443 | 3/1909 | Jones | 81/128 |
| 2,582,444 | 1/1952 | Lucht | 81/128 |

*Primary Examiner*—Frederick R. Schmidt
*Assistant Examiner*—J. T. Zatarga
*Attorney, Agent, or Firm*—Ladas & Parry

[57] ABSTRACT

A universal multi-socket ratchet wrench comprises in combination a socket gripping body having a plurality of cross slot equally formed around the longitudinal wall of the open head for respectively and movably receiving a gripping member therein defining an adjustable hexagonal socket thereof; a rotary conical member having screw teeth at the larger end and a driving arm at the other end being positioned within an annular recess of the socket gripping body for matching with and making adjustment to the gripping members thereof; a force applying member with control and driving means installed therein being coupled with the socket and gripping body relative to the rotary conical member thereof; and a telescopic and pitchable handle connected to the force applying member, whereby, with the arrangement of the control and driving means, the socket gripping body is adaptable to any hexagonal nuts or other bolt type fasteners for tightening and loosening operations, that can be performed at any direction by the user without occurring accidental disengagement nor causing any damage to the workpiece.

8 Claims, 2 Drawing Figures

UNIVERSAL MULTI-SOCKET RATCHET WRENCH

BACKGROUND OF THE INVENTION

1. Field of the Invention

This invention relates generally to hand operated wrench particularly to a universal multi-socket ratchet wrench wherein an adjustable hexagonal socket is adaptable to any hexagonal nuts or other bolt type fastener for tightening and loosening operations.

2. Description of the Prior Art

Conventionally, hand operated wrench for tightening and loosening hexagonal nuts includes open end wrench, box wrench, adjustable wrench and socket wrench, of which socket wrench requires a set of sockets in various specifications for taking replacement according to the size of nuts or other bolt type fasteners. The open end wrench has a major defect in its structure because during operation, the torsion from the wrench is only applied to the opposing two points of a quardrangle or hexagonal bolt head or nut, often resulting in either hurting the user from an accidental disengagement between the wrench and the workpiece or damaging the bolt head or nut. Although the box wrench has partially solved the problem yet it still has its limit similar to that of the open-end wrench, i.e. the workpiece must protrude out of the main body thereof. Besides, both the open end wrench and the box wrench have to be separately prepared in different sizes in conjunction with the different sizes of the bolt heads and nuts. Accordingly, an adjustable wrench and socket wrench are produced to meet the requirement. However, the adjustable wrench has the same defect as that of the open end wrench in torsion application, and the socket wrench has to separately prepare a plurality of different sockets according to the different specifications of bolts and nuts. In general, the prior art wrenches have the following problems, in which:

(1) Different sockets have to be prepared for replacement selection according to the requirement of different size of bolts and nuts, making the operations inconvenient and time consuming as well;

(2) As different specifications of the bolt and nut have to be adapted in manufacturing different wrenches and/or sockets, not only more materials are required but also more costs and working time are mounted accordingly; and (3) In order to carry different components of the wrench, a larger tool case is required, making the carrying inconvenient to the user.

SUMMARY OF THE INVENTION

It is accordingly an object of the present invention to provide a universal multi-socket ratchet wrench that overcomes the foregoing problems associated with the prior arts.

It is another object of the present invention to provide a universal multi-socket ratchet wrench with a socket gripping body having a plurality of gripping members slidably accommodated therein defining an adjustable hexagonal socket thereof for adapting to any size of bolt heads and nuts without causing any damaging or accidental disengagement during tightening and loosening operations It is still another object of the present invention to provide a universal multi-socket ratchet wrench with control and driving means relative to the socket gripping body so that a variable socket is available all the time without requiring additional replacement of socket so as to promote working efficiency and facilitate carrying actions.

It is still another object of the present invention to provide a universal multi-socket ratchet wrench with a coupling-tooth structure formed between a force applying member and the socket gripping body so as to ensure a strong and safe stand against the torsion applied thereto.

It is still another object of the present invention to provide a universal multi-socket ratchet wrench with a telescopic and pitchable handle structure so as to enable the user to operate at any working angle as the situation may dictate.

According to the present invention, these and other objects are achieved by providing a universal multi-socket ratchet wrench which comprises a combination a socket gripping body having a plurality of cross slot equally formed around the longitudinal wall of the open head for respectively and movably receiving a gripping member therein defining an adjustable hexagonal socket thereof; a rotary conical member having screw teeth at the larger end for being engaged with the gripping members within a recess of the socket gripping body, and a driving arm at the other end for being coupled with a force applying member, which has a tooth structure at one end for being coupled with a tooth portion of the socket gripping body relative to the rotary conical member, and a force transmission projection extending from the other end of the force applying member with control and driving means installed therein for making the required adjustment with respect to the socket gripping body; and a telescopic and pitchable handle connected to the force applying member so that tightening and loosening operations can be performed at any direction by the user for any hexagonal bolt type fasteners and nuts.

Further characteristics and advantages will become more apparent from the description of one example of a preferred but not sole form of embodiment for the invention, given below with reference to the accompanying drawings.

DETAILED DESCRIPTION OF THE PREFERRED EMBODIMENT

Figure 1:
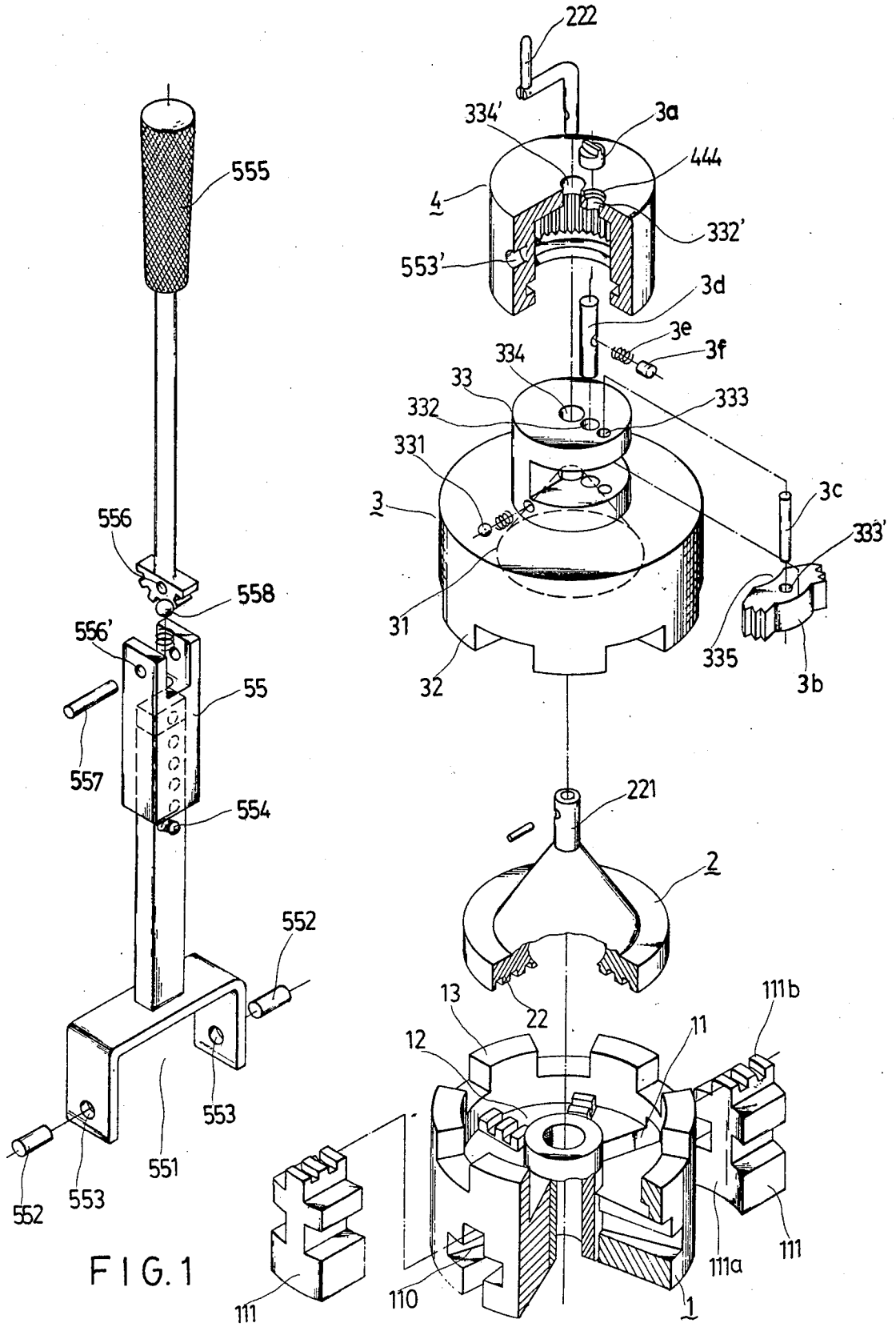
FIG. 1 is an exploded and perspective view of a universal multi-socket ratchet wrench according to this invention.

Referring to FIG. 1, a universal multi-socket ratchet wrench according to this invention comprises in combination a cylindrical socket gripping body 1 having an open annular recess 12 circumscribed by a ring of spaced tooth 13 at one end, and six cross slots 110 equally formed around the longitudinal wall of the other open end for respectively and movably receiving a gripping member 111, which has a concave angle 111*a* formed vertically in 120° on one side at one end and a row of equally spaced tooth 111*b* at the other, and six sliding slots 11 horizontally formed in the middle section of the cylindrical socket gripping body 1 with respect to the cross slots 110 thereof; in this connection, when all the gripping members 111 are slidably received in the cross slots 110, the concave angle 111*a* of the gripping member 111 will form an adjustable hexagonal socket therein for being adaptable to any hexagonal nuts or other bolt type fasteners to be tightened or loosened thereat, and the tooth portion 111*b* of the gripping member 11 extends respectively through the slidening slots 11; a rotary conical member 2 having a rabbet joint 221 for being connected to a driving arm 222 at one end and a plurality of screw teeth 22 formed at another end and being positioned in the annular recess 12 of the cylindrical socket gripping body 1 with the screw teeth 22 respectively worm-meshed with the tooth portion 111*b* of the gripping members 111 so that when the rotary conical member 2 is rotated clockwise or counterclockwise thereabout, the screw teeth 22 will make the gripping members 111 side inward or outward within the cylindrical socket gripping body 1 so as to contract or dilate the hexagonal socket thereof for firmly engaging or disengaging the bolt head or nut in performing the required tightening or loosening operations thereat; and a force applying member 3 having a force transmission projection 33 extending at one end and an open conical recess 31 in the middle with a ring of spaced teeth 32 formed at the other end for accommodating the rotary conical member 2 positioned therein and fitly coupled with the cylindrical socket gripping body 1 through the scarfing of both tooth portions 13, 32 so as to ensure a strong and safe stand against the torsion applied thereat without accidental structual disengagement occurring therefrom.

The force transmission projection 33 of the force applying member 3 has a through opening 334 for rotatably receiving the driving arm structure 222 of the rotary conical member 2, and an annular recess 331 formed in the longitudinal wall for installing a gear block 3*b*, which is movably positioned therein with the arch surface facing outward through a joint pin 3*c* being located in a pin hole 333' thereof aligned with a pin hole 333 in the projection 33, and which has a sliding slot 335 formed in the concave surface for movably receiving a sliding stem 3*f* being coupled with a spring 3*e* and fixed perpendicularly to a driving rod 3*d* which is rotatably located in an aperture 332 in the projection 33, constituting a rachet structure therein. A coupling sleeve 4 having an annular toothed recess 44 formed within the longitudinal wall corresponding to the annular recess 331 of the projection 33 is fixed closely around the periphery of the projection 33 through a coupling screw 331 with the upper end of the driving rod 3*d* located in an aperture 332' and the through opening 334' being in line with the through opening 334 of the projection 33. A control disk 3*a* is coupled with the upper end of the driving rod 3*d* in a round recess 44 formed around the aperture 332'. As the driving rod 3*d* is movably coupled with the gear block 3*b*, by turning the control disk 3*a* clockwise, the driving rod 3*d* will move the gear block 3*b* to protrude at right side within the coupling sleeve 4 so as to keep the coupling sleeve 4 together with the force applying member 3 to be rotated in right direction only, and when the control disk 3*a* is turned counterclockwise, all the rotation operations specified above will be reversed thereat; while, when the control disk 3*a* is kept at a neutral position (middle), the driving rod 3*d* will keep the gear block 3*b* in a balanced position therein so as to enable the coupling sleeve 4 together with the force applying member 3 to be moved in race rotation therearound. Therefore, the torsion thereof can be applied to the socket gripping body at any direction.

An operating handle includes a connecting link 5 having an open joint 551 at one end being movably connected to the coupling sleeve 4 by a lock pin 552 through a pair of opposite pin holes 553 thereof lined with a through pin hole 553' in the coupling sleeve 4; a plurality of elastic ball fittings 554 installed on one side at the other end being telescopically coupled within the hollow section of a handle joint 55; and a grip 555 having a semi-globoid gear at one end pivotally connected to the open end of the handle joint 55 against a set of elastic bal fitting 558 installed in the middle surface of the open end and through a pin shaft 557 fixed in pin holes 556, 556'; therefore, the operating handle can be pitched up and down in 180° and telescopically rotated therearound in either directions.

Figure 2:
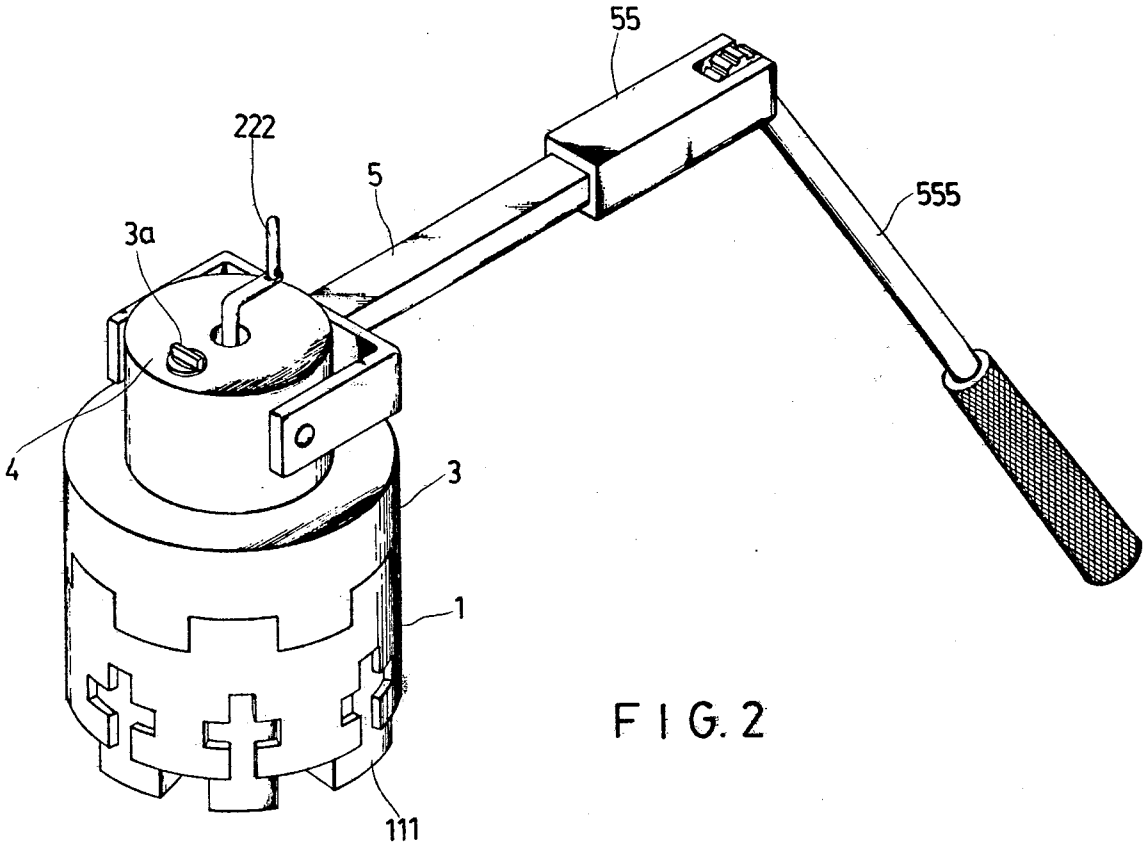
FIG. 2 is an assembly representation of FIG. 1.

As shown in FIG. 2, the driving arm 222 of the rotary conical member 2 extends over the top of the coupling sleeve 4, which is fixedly matched with the force applying member 3, for facilitating manual operation in rotating the conical member 2 therein in either direction so as to adjust the gripping memners 111 in contracting or dilating the hexagonal socket thereof for making it adaptable to the size of a hexagonal nut or other bolt type fasteners to be tightened or loosened thereat. The control disk 3*a* on top of the coupling sleeve 4 can be set in three positions—right, left, and neutral so as to enable the force applying member 3 together with the socket gripping body 1 to make a single direction turn or race rotation therearound.

The structure of this invention can stand strong torsion stress, and, owing to the uniform action of the hexagonal socket, makes no any damage to the workpiece thereof.

While a preferred embodiment has been illustrated and described, it will be apparent that many changes may be made in the general construction and arrangement of the invention without departing from the spirit thereof, and it is therefore desired that the invention be not limited to the exact disclosure but only to the extent of the appending claims.

What I claim is:

1. A universal multi-socket ratchet wrench comprising in combination:

a socket gripping body having a plurality of cross slot equally formed around the longitudinal wall of the open head at one end and an annular recess circumscribed by a ring of spaced tooth at the other;

a plurality of gripping member respectively and movably received in said cross slots forming an adjustable hexagonal socket thereof;

a rotary conical member having a driving arm structure at one end and a plurality of screw teeth at the other being positioned within said annular recess of said socket gripping body with respect to said gripping members;

a force applying member having a force transmission projection at one end, a conical recess in the middle, and a spaced tooth portion at the other end, being fitly scarfed to the toothed portion of said socket gripping body in relation to said rotary conical member positioned therein;

a coupling sleeve connected to said force applying member;

control means installed in said coupling sleeve with respect to said force applying member and socket gripping body; and an operating handle telescopically and pitchably coupled with said coupling sleeve, whereby, with the arrangement of said driving structure and said control means, said hexagonal socket is adaptable to any hexagonal nuts or other bolt type fasteners for performing tightening and loosening operations by the user at any directions.

2. A universal multi-socket ratchet wrench as claimed in claim 1 wherein said socket gripping body has a plurality of sliding slots horizontally formed in the middle section in connection with said cross slots for slidably and respectively receiving said toothed portion of said gripping members.

3. A universal multi-socket ratchet wrench as claimed in claim 1 wherein said gripping members each has a concave angle formed vertically on one side in approximately 120° at one end in forming a uniform hexagonal socket thereof, and each has a row of toothed portion at the other for being respectively and slidably received in said sliding slots.

4. A universal multi-socket ratchet wrench as claimed in claim 1 or 3 wherein said screw teeth of said rotary conical member are worm-meshed with said toothed portion of said gripping members so that by rotating said rotary conical member clockwise or counter clockwise thereabout within said annular recess of said socket gripping body, said screw teeth will make said gripping members slide inward or outward within said socket gripping body so as to contract or dilate the hexagonal socket thereof for firmly engaging or disengaging the bolt head or nut in performing the required tightening or loosening operations thereat.

5. A universal multi-socket ratchet wrench as claimed in claim 1 wherein the rotation of said rotary conical member is manually operated through said driving arm arranged on top of said coupling sleeve.

6. A universal multi-socket ratchet wrench as claimed in claim 1 wherein said control means is a ratchet structure installed therein for controlling the rotation direction of said socket grip body through said force applying member.

7. A universal multi-socket ratchet wrench as claimed in claim 1 wherein said operating handle comprises: a connecting link having an open joint at one end for being movably connected to said coupling sleeve; a plurality of elastic ball fittings installed on one side at the other of said connecting link; a handle joint having a hollow section at one end for telescopically receiving the other end of said connecting link and an open end at the other end; a set of elastic ball fitting installed in the middle surface of the open end of said handle joint; and a grip having a semi-globoid gear at one end being pivotally connected to the open end of said handle joint against said elastic ball fitting thereof, whereby, said operating handle can be pitched up and down in a desired degree and telescopically rotated in either directions.

8. A universal multi-socket ratchet wrench as claimed in claim 4 wherein the rotation of said rotary conical member is manually operated through said driving arm arranged on top of said coupling sleeve.

* * * * *

UNITED STATES PATENT AND TRADEMARK OFFICE

CERTIFICATE OF CORRECTION

PATENT NO. : 4,436,004

DATED : March 13, 1984

INVENTOR(S) : Hui-Huang CHANG

It is certified that error appears in the above-identified patent and that said Letters Patent is hereby corrected as shown below:

Title page, Foreign Application Priority Data, delete "Oct. 5, 1981 [TW] Taiwan.....7025849"

Signed and Sealed this

*Twenty-second* Day of *April 1986*

[SEAL]

*Attest:*

DONALD J. QUIGG

*Attesting Officer*

*Commissioner of Patents and Trademarks*